United States Patent [19]

Ramstad

[11] 3,951,036

[45] Apr. 20, 1976

[54] SAFE AND ARM DEVICE

[75] Inventor: David L. Ramstad, Portsmouth, R.I.

[73] Assignee: The United States of America as represented by the Secretary of the Navy, Washington, D.C.

[22] Filed: July 22, 1974

[21] Appl. No.: 490,522

[52] U.S. Cl. ..... 89/1 B; 102/7; 102/16

[51] Int. Cl.[2] ..... F42C 3/00

[58] Field of Search ..... 102/7, 16; 89/1 B; 9/319, 320; 114/206 A

[56] References Cited

UNITED STATES PATENTS

| | | | |
|---|---|---|---|
| 3,207,115 | 9/1965 | Anderson | 89/1 B |
| 3,532,057 | 10/1970 | Aubrey | 102/81 |
| 3,839,984 | 10/1974 | Hinves et al. | 102/16 |

*Primary Examiner*—Samuel W. Engle
*Assistant Examiner*—S. A. Cangialosi
*Attorney, Agent, or Firm*—Richard S. Sciascia; Arthur A. McGill; Prithvi C. Lall

[57] ABSTRACT

A safe and arm device for igniting a propellant charge in a deep water embedment anchor which comprises a cartridge of a high pressure gas, an inflator in communication with the cartridge, a high pressure two-way normally closed valve connected to the cartridge via the inflator, a medium pressure three-way valve in communication with the two-way valve and a gold shear disc, and a firing pin. The firing pin is connected to an out-of-line slider having a detonator housed therein. The detonator plunger is moved under hydrostatic pressure so as to bring it in line with the firing pin. The gas under high pressure in the cartridge is released by the inflator and allowed to pass through the two valves so as to shear the gold disc and move the firing pin which strikes the detonator, and thus sets off the propellant in the anchor barrel and drives the anchor firmly into the ocean floor.

6 Claims, 2 Drawing Figures

SAFE AND ARM DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a deep water embedment anchor and more particularly to a safe and arm device, hereinafter called S&A device, for igniting a propellant charge in a deep water embedment anchor so as to drive the anchor firmly and securely into the ocean floor.

A considerable effort has been made to improve undersea anchoring by using propellant anchors because of serious limitations of conventional anchors. Consequently, S&A devices for igniting propellant charges in embedment anchors have been developed which contain electric detonators, radiation filters, lead azide mild detonating fuses, and flat gasket water seals. Furthermore, a S&A mechanism using a pair of firing pins activated by hydrostatic pressure to activate a pair of detonators housed in an out-of-line slider has also been devised. However, such mechanisms are slow in reaction and are unpredictable, particularly at great depths. It is thus desirable to have a simple S&A device for igniting propellant charges in an embedment anchor which is fast in its reaction time and is effective at greater depths.

SUMMARY OF THE INVENTION

The objects and advantages of the present invention are accomplished by using a simple S&A device for igniting propellant charges in a deep water embedment anchor. This S&A device is simple, having no electro-explosive elements and is not susceptible to electromagnetic radiation. This S&A device is also quick in its response in contradistinction to a slow response S&A mechanism based on hydrostatic pressure for its operation. This S&A device comprises a cartridge of an inert gas such as nitrogen at high pressures, an inflator which regulates the flow of nitrogen gas, a two-way normally closed solenoid valve in communication with the container of nitrogen gas, a three-way solenoid valve normally vented to atmosphere which is in communication with the two-way valve on one side and a gold shear disc on the other side, a firing pin piston-cylinder arrangement, a detonator housed in a spring loaded out-of-line slider, a lead cup and a lead block. All these elements are contained in an aluminum housing and the two valves are actuated electronically by means of an electronic package. The device is lowered in water and the detonator housed in a spring loaded plunger is exposed to hydrostatic pressure after a safety pin to keep the plunger in position is removed, thus subjecting the plunger to hydrostatic pressure. Under a predetermined value of hydrostatic pressure which is attained below a certain depth of sea water, the spring loaded plunger is moved so as to line up the detonator with the spring-biased firing pin. When the solenoid valves are actuated by the electronic package and the inflator is used to allow the nitrogen gas to pass through the valves to shear the gold disc, the firing pin is propelled so as to strike the detonator and sets off the propellant in the anchor barrel and drives the anchor into the sea bottom firmly and safely.

An object of this invention is to have an S&A device for igniting a propellant charge in a deep water embedment anchor which is simple and which is not susceptible to electromagnetic radiation.

Another object of this invention is to have an S&A device which can be used for a whole family of embedment anchors.

Still another object of this invention is to have an S&A device for embedment anchors which has a fast reaction time and is independent of hydrostatic pressure for its setting off.

Still another object of this invention is to use an S&A device for embedment anchors which is provided with a threeway safety valve to make the operation of the device safe.

Other objects, advantages and novel features of the present invention will become apparent from the following detailed description of the invention when considered in conjunction with the accompanying drawings wherein:

DESCRIPTION OF A PREFERRED EMBODIMENT

Figure 1:
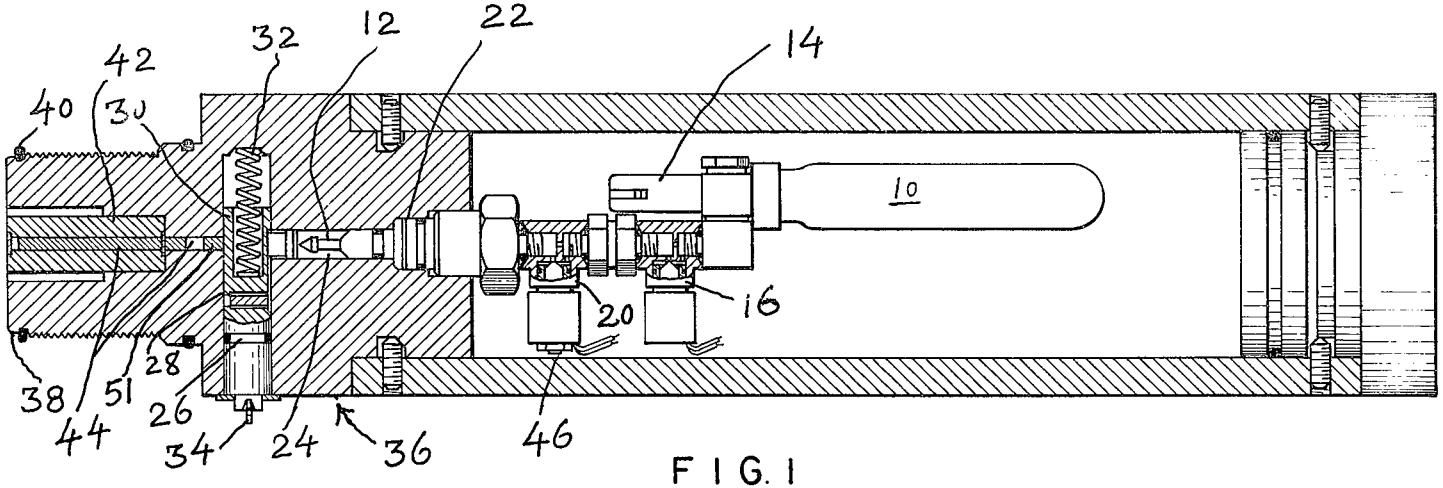
FIG. 1 represents a cross-sectional view of an S&A device built according to the teachings of this invention.
Figure 2:
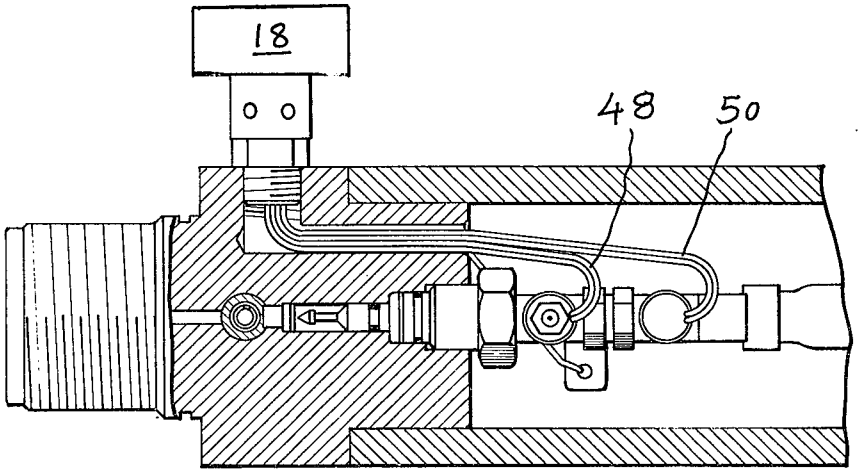
FIG. 2 represents another sectional view of the S&A device showing the connection between the two valves and the electronic package used.

Referring to the drawings, wherein like reference characters designate identical or corresponding parts in various figures, and more particularly to the first figure thereof, FIG. 1 shows a cross-sectional view of the S&A device built according to the teachings of this invention. A gas cylinder 10 is used to store an inert gas such as nitrogen under high pressure to provide a potential energy source required to propel the firing pin 12. The exit of nitrogen gas in cylinder 10 is controlled by an inflator 14 which allows the gas to enter the inlet side of a high pressure two-way valve 16. Two-way valve 16 is energized by electronic package 18 from its normally closed position. The exit side of two-way valve 16 is connected to the inlet side of a medium pressure three-way valve 20, the exit side of which is connected to a gold shearing disc 22 which in turn is in communication with firing pin 12 housed in a cylinder 24. A detonator 26 is placed in the out-of-line slider 28 which is coupled to a spring-biased plunger 30 by spring 32. The plunger is provided with a safety pin 34 which keeps the detonator 26 at a fixed position in its inactivated state as shown in FIG. 1. Housing or block 36 is threaded at its end 38 in order to couple it to the breach end of a barrel which forms an integral part of an embedment anchor. When S&A device is not in use, a cap is put on end 38 thereof so as to keep foreign materials out of the S&A device. O-ring 40 is used to make the cap fit tightly over block end 38. Block 36 also has an inner housing or lead block 42 which is used to enable parts of block 36 to be used more than once. A cylindrical passageway 44 is made through housing 36 and lead block 42 and line charge is deposited in passageway 44. When S&A device is not in use, inflator 14 is out of communication with cylinder 10, two-way valve is in closed position and three-way valve is also in closed position but vented to atmosphere through passageway 46. Two-way valve 16 is a high pressure valve, preferably operable up to pressures of 1100 pounds per square inch (psi) and is a solenoid actuated valve energized by a source in electronic package 18. Three-way valve 20 is also a solenoid valve energized by the source in electronic package 18 and is operable up to a medium pressure limit of 750 psi.

In operation, block 36 of the S&A device is coupled to the breech of an embedment anchor at its end 38. Before lowering the device in water for use, safety pin 34 is removed after the S&A device is coupled to the embedment anchor which is then lowered in water. At a predetermined depth of water, sufficient hydrostatic pressure is developed which moves plunger 28 having detonator 26 housed therein in such a way that detonator 26 aligns itself with firing pin 12. As an example, sufficient hydrostatic pressure is developed when the S&A device is lowered into the water below a depth of 100 feet. Inflator 14 is used to puncture cylinder or cartridge 10 releasing nitrogen gas under high pressure into the inlet region of two-way valve 16 before the unit is lowered into the water. Upon touch down of the anchor, two-way valve 16 is energized by means of electronic package 18 which releases the potential energy source, i.e., nitrogen gas under high pressure. Three-way valve 20 is also energized by means of electronic package 18 which allows nitrogen gas to flow there through and develop sufficient pressure to shear gold disc 22 and in turn propels the firing pin 12 to activate the detonator 26 which is in line with the firing pin. The arming plunger 28 keeps the detonator 26 out of the firing pin explosive train line until the device is at a preselected arm depth. The plunger will move out-of-line if the anchor is raised before its firing has been initiated. The explosive train in passageway 44 generates the shock wave that initiates the primer in the cartridge which is composed of the detonator 26, lead cup 51 and lead block 42. The detonator 26 is the first element in the explosive train and its function is to initiate the lead cup line charge after being hit by the firing pin. The lead cup is a small metallic cylinder which encloses a capsule of line charge. The lead block is designed to minimize the deformation of the threaded section of the block 36 and to facilitate the loading of line charge.

The housing and body provide the mechanical connection to the breach block and cartridge of the anchor and maintains waterproof integrity of the internal components. Electrical connectors 48 and 50 connect the S&A device to the electronic package 18 of the anchor.

Briefly stated, the S&A device comprises a spring-biased plunger having a detonator embedded therein, a firing pin which is propelled by a source of potential energy such as an inert gas like nitrogen at high pressure. A firing pin is movable in a cylinder under the influence of the potential energy source and the detonator is made to align with the firing pin by hydrostatic pressure developed when the S&A device is lowered in the water. The firing pin is thus moved by the potential energy source to strike the detonator which is brought in alignment with the firing pin under hydrostatic pressure when the assembly is below a certain depth of water in the sea. The detonator in turn sets off the line which in turn sets off the propellant in the anchor barrel and drives the anchor into the bottom of the sea firmly and safely.

Obviously many modifications and variations of the present invention are possible in the light of the above teachings. As an example, some other inert gas or air can be used as a source of potential energy to drive the firing pin. Furthermore, a different arrangement can be used to bring the detonator in line with the firing pin after the device is lowered beyond a preselected depth in the water. It is therefore to be understood that within the scope of the appended claims the invention may be practiced otherwise than as specifically described.

I claim:

1. A safe and arm device for igniting a propellant charge in a deep water embedment anchor which comprises:

a block having a first end and a second end and including an elongated chamber centrally disposed therein, said block being demountably coupled at said first end thereof to the deep water embedment anchor and being detachable at said second end thereof, said block further having a longitudinal opening at said first end extending up to said elongated chamber and a lateral opening away from said first end and dividing said longitudinal opening into a first section and a second section;

an out-of-line slider adjustably positioned in said lateral opening in said block, said slider being selectively moveable relative to said first and second sections of said longitudinal opening, said first section being adjacent the elongated chamber;

a firing pin being moveably mounted in said first section of said longitudinal opening;

a shearing disc being housed in said longitudinal opening, said shearing disc being in communication with said firing pin at the end of said firing pin away from said lateral opening;

a three-way valve having an inlet, a first outlet, and a second outlet and being housed in said elongated chamber and mounted in said longitudinal opening of said block in said first section of said longitudinal opening of said block, said three-way valve being in communication with said shearing disc at said first outlet thereof and in communication with atmosphere at said second outlet thereof;

a two-way valve having an inlet and an outlet and being housed in said elongated chamber, said two-way valve being in communication with the inlet of said three-way valve at the outlet thereof;

an inflator having a first end and a second end, said inflator being in communication with said two-way valve at the inlet thereof; and a cartridge of an inert gas under pressure, said cartridge being in communication with the second end of said inflator.

2. The device of claim 1 wherein said two-way and three-way are solenoid actuated valves being energized by an electronic package.

3. The device of claim 2 wherein said three-way valve is vented to atmosphere for safe operation of the device.

4. The device of claim 3 wherein said out of line slider includes a spring biased plunger and a detonator.

5. The device of claim 4 wherein said block further includes a lead block being mounted therein inside said block adjacent said first end thereof and surrounding said second section of said longitudinal opening.

6. The device of claim 5 which further includes a lead cup being housed inside said second section of said longitudinal opening of said block and adjacent said lateral opening.

* * * * *